US008974659B2

(12) United States Patent
Dierickx

(10) Patent No.: US 8,974,659 B2
(45) Date of Patent: Mar. 10, 2015

(54) ALIPHATIC GASOLINE COMPONENT AND PROCESS TO PREPARE SAID GASOLINE COMPONENT

(75) Inventor: Jan Lodewijk Maria Dierickx, Amsterdam (NL)

(73) Assignee: Shell Oil Company, Houston, TX (US)

( * ) Notice: Subject to any disclaimer, the term of this patent is extended or adjusted under 35 U.S.C. 154(b) by 663 days.

(21) Appl. No.: 12/761,252

(22) Filed: Apr. 15, 2010

(65) Prior Publication Data

US 2010/0197982 A1 Aug. 5, 2010

(30) Foreign Application Priority Data

May 26, 2004 (EP) ..... PCT/EP2004/050931
Nov. 30, 2004 (EP) ..... 04106189

(51) Int. Cl.

| | |
|---|---|
| ***C10G 57/00*** | (2006.01) |
| ***C10G 55/06*** | (2006.01) |
| ***C10G 63/04*** | (2006.01) |
| ***C10L 1/06*** | (2006.01) |

(52) U.S. Cl.

CPC ..... *C10G 57/005* (2013.01); *C10G 55/06* (2013.01); *C10G 63/04* (2013.01); *C10L 1/06* (2013.01); *C10G 2300/1022* (2013.01); *C10G 2400/02* (2013.01); *Y10S 208/95* (2013.01)

USPC ..... 208/70; 208/141; 208/950

(58) Field of Classification Search

USPC ..... 208/67, 69, 70, 134, 141, 950; 585/14, 585/330

See application file for complete search history.

(56) References Cited

U.S. PATENT DOCUMENTS

| | | | | |
|---|---|---|---|---|
| 3,992,474 | A | 11/1976 | Sobel | 260/683.48 |
| 4,125,566 | A | 11/1978 | Dinh et al. | 260/676 |
| 4,471,145 | A | 9/1984 | Chu et al. | 585/322 |
| 4,684,756 | A | 8/1987 | Derr, Jr. et al. | 585/330 |
| 5,278,114 | A | 1/1994 | Wielers et al. | 502/67 |
| 5,481,057 | A | 1/1996 | Bell et al. | 585/722 |
| 6,436,278 | B1 | 8/2002 | Benazzi et al. | 208/62 |
| 6,566,569 | B1 * | 5/2003 | Chen et al. | 585/324 |
| 2002/0111521 | A1 | 8/2002 | O'Rear | 585/326 |
| 2004/0074810 | A1 | 4/2004 | Hoek et al. | 208/113 |

FOREIGN PATENT DOCUMENTS

| | | | |
|---|---|---|---|
| AU | 698391 | 10/1998 | C07C 1/00 |
| DE | 19744109 | 4/1999 | |
| EP | 454256 | 10/1991 | C07C 1/04 |
| EP | 512635 | 11/1992 | C07C 1/08 |
| EP | 832171 | 4/1998 | C10G 45/64 |
| EP | 1359207 | 11/2003 | C10L 1/06 |
| WO | WO9934917 | 7/1999 | B01J 23/75 |
| WO | WO0029511 | 5/2000 | C10G 45/64 |
| WO | WO2004044106 | 5/2004 | C10L 1/06 |
| WO | WO2004106462 | 12/2004 | C10G 11/05 |

OTHER PUBLICATIONS

"The Alkyclean Process: A new solid acid catalyst gasoline alkylation technology," NPRA 2002 Annual Meeting, Mar. 17-19, 2002, pp. 1-18.

"Exxon Sulfuric acid alkylation technology," Handbook of Petroleum Refining Processes, 2nd Edition, R.A. Meyers, Ed., pp. 1.3-1.14.

* cited by examiner

*Primary Examiner* — Renee E Robinson

(57) ABSTRACT

A process to prepare an aliphatic gasoline component comprising more than 90 wt % of trimethyl substituted compounds and monomethyl substituted compounds in a weight ratio of trimethyl to monomethyl compounds of at least 0.03 by (a) contacting a Fischer-Tropsch synthesis product with a catalyst comprising an acidic matrix and a large pore molecular sieve in a riser reactor at a temperature of between 450 and 650° C. at a contact time of between 1 and 10 seconds and at a catalyst to oil ratio of between 2 and 20 kg/kg; (b) isolating from the product of step (a) a gasoline fraction and a fraction comprising iso-butane and iso-butylene; (c) subjecting the iso-butane and the iso-butylene obtained in step (b) to an alkylation step to prepare a trimethyl substituted pentane; and (d) combining the gasoline fraction with the product rich in trimethyl substituted pentane.

10 Claims, No Drawings

ALIPHATIC GASOLINE COMPONENT AND PROCESS TO PREPARE SAID GASOLINE COMPONENT

This application is a divisional of application Ser. No. 11/597,312 filed Nov. 22, 2006, which claims priority to International Application PCT/EP2004/050931 filed May 26, 2004 and to European Patent Application 04106158.1 filed Nov. 29, 2004.

FIELD OF THE INVENTION

The invention is directed to an aliphatic gasoline component, a gasoline formulation and a process to prepare said gasoline component.

BACKGROUND OF THE INVENTION

It is known that paraffinic products boiling in the gasoline range can be prepared from a Fischer-Tropsch derived synthesis product. Preparing a gasoline having an acceptable octane number from a Fischer-Tropsch product is however not straightforward. This because the Fischer-Tropsch product as such consists for a large portion of normal paraffins which have a low octane value or contribution. Various attempts have been made to provide a process, which can prepare a gasoline having an acceptable octane value from a Fischer-Tropsch product.

EP-A-512635 discloses a process wherein a gasoline having a motor octane number of 85 is obtained from a Fischer-Tropsch process by means of a hydroisomerisation process. The process also involves separation of normal and iso-paraffins using a zeolite bed.

U.S. Pat. No. 6,436,278 discloses a similar process as EP-A-512635. The examples illustrate that the gasoline as directly obtained in a hydroisomerisation step has an octane number of 43. After enrichment of the gasoline fraction in iso-paraffins the octane number of 68 was obtained.

US-A-20020111521 discloses a process to prepare a gasoline by subjecting a Fischer-Tropsch wax to a so-called Paragon reactor to obtain lower olefins. These lower olefins are subsequently oligomerised to obtain highly branched iso-olefins with a size range of between $C_{12}$ and $C_{20}$.

EP-A-454256 discloses a process to prepare lower olefins from a Fischer-Tropsch product by contacting this product with a ZSM-5 containing catalyst at a temperature of between 580 and 700° C. in a moving bed reactor at a catalyst to oil ratio of between 65 and 86 kg/kg.

U.S. Pat. No. 4,684,756 discloses a process to prepare a gasoline fraction directly by catalytic cracking of a Fischer-Tropsch wax as obtained in an iron catalysed Fischer-Tropsch process. The gasoline yield is 57.2 wt %.

A disadvantage of some of the above processes involving hydro-processing is that the isomerised product will be predominantly mono-methylparaffins. Even after enrichment in iso-paraffins, the octane rating remains low.

The object of the present invention is to provide a paraffinic gasoline component having an acceptable motor octane number, and a process to prepare this gasoline from a Fischer-Tropsch product, in a high yield.

SUMMARY OF THE INVENTION

The invention is directed to the following gasoline component. An aliphatic gasoline component comprising more than 90 wt % of a mixture of trimethyl substituted compounds and monomethyl substituted compounds in a weight ratio of trimethyl to monomethyl compounds of at least 0.03 and wherein the compounds may be paraffins and olefins.

The invention is also directed to a gasoline fuel composition comprising the aliphatic gasoline component as described above, one or more additives, an aromatics content of between 1 and 22 vol % (as measured by ASTM D5580-95), a motor octane number of greater than 90 and a sulphur content of below 15 ppm by weight (as measured by ASTM D5453-93).

The invention is also directed to a process to prepare an aliphatic gasoline component by (a) contacting a Fischer-Tropsch synthesis product with a catalyst system comprising a catalyst, which catalyst comprises an acidic matrix and a large pore molecular sieve in a riser reactor at a temperature of between 450 and 650° C. at a contact time of between 1 and 10 seconds and at a catalyst to oil ratio of between 2 and 20 kg/kg, (b) isolating from the product of step (a) a gasoline fraction and a fraction comprising iso-butane and iso-butylene;

(c) subjecting the iso-butane and the iso-butylene obtained in step (b) to an alkylation step to prepare a trimethyl substituted pentane; and (d) combining the gasoline fraction obtained in step (b) with the product rich in trimethyl substituted pentane as obtained in step (c).

DETAILED DESCRIPTION OF THE INVENTION

Applicants found that an aliphatic gasoline can be obtained by catalytically cracking a Fischer-Tropsch synthesis product in combination with a subsequent alkylation reaction. In a preferred embodiment, a relatively heavy Fischer-Tropsch product is used as feed to the catalytic cracking step (a). The enrichment of the gasoline fraction with multibranched paraffins or olefins as obtained in step (c) increases the octane number to the level that makes the gasoline suitable as a gasoline fuel or as a gasoline blend component. A further advantage is that no hydro-processing is required, other than an optional hydrofinishing of the gasoline blend to meet a maximum olefins specification, which is required in some regions. For example, the Fischer-Tropsch synthesis product can be directly used in the process according to the invention without having to hydrotreat the feed. Another advantage is that use can be made of well-known processes known for fluid catalytic cracking (FCC), step (a), and the alkylation, step (c), processes.

The Fischer-Tropsch synthesis product may in principle be any reaction product as obtained when performing the well know Fischer-Tropsch synthesis reaction. Preferably use is made of a relatively heavy Fischer-Tropsch product in step (a). This heavy feed preferably has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}$+ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch product used in step (a) may suitably range from below 200 up to 450° C. Preferably any compounds having 4 or less carbon atoms and any compounds having a boiling point in that range are separated from a Fischer-Tropsch synthesis product before the Fischer-Tropsch synthesis product is used in step (a).

Applicants found that a high yield to gasoline can be achieved starting from such a Fischer-Tropsch product, thus including the Fischer-Tropsch fractions boiling in the gasoline range. Thus a high gasoline yield relative to the Fischer-Tropsch product is achievable.

The relatively heavy Fischer-Tropsch synthesis product can be obtained by any process, which yields a relatively heavy Fischer-Tropsch product. Not all Fischer-Tropsch processes yield such a heavy product. Preferred processes are the cobalt catalysed Fischer-Tropsch processes. An example of a suitable Fischer-Tropsch process is described in WO-A-9934917 and in AU-A-698391. These processes may yield a Fischer-Tropsch product as described above.

A preferred catalyst to be used to obtain the relatively heavy Fischer-Tropsch product is suitably a cobalt-containing catalyst as obtainable by (aa) mixing (1) titania or a titania precursor, (2) a liquid, and (3) a cobalt compound, which is at least partially insoluble in the amount of liquid used, to form a mixture; (bb) shaping and drying of the mixture thus obtained; and (cc) calcination of the composition thus obtained.

Preferably at least 50 weight percent of the cobalt compound is insoluble in the amount of liquid used, more preferably at least 70 weight percent, and even more preferably at least 80 weight percent, and most preferably at least 90 weight percent. Preferably the cobalt compound is metallic cobalt powder, cobalt hydroxide or an cobalt oxide, more preferably $Co(OH)_2$ or $CO_3O_4$. Preferably the cobalt compound is used in an amount of up to 60 weight percent of the amount of refractory oxide, more preferably between 10 and 40 wt percent. Preferably the catalyst comprises at least one promoter metal, preferably manganese, vanadium, rhenium, ruthenium, zirconium, titanium or chromium, most preferably manganese. The promoter metal(s) is preferably used in such an amount that the atomic ratio of cobalt and promoter metal is at least 4, more preferably at least 5. Suitably at least one promoter metal compound is present in step (aa). Suitably the cobalt compound is obtained by precipitation, optionally followed by calcination. Preferably the cobalt compound and at least one of the compounds of promoter metal are obtained by co-precipitation, more preferably by co-precipitation at constant pH. Preferably the cobalt compound is precipitated in the presence of at least a part of the titania or the titania precursor, preferably in the presence of all titania or titania precursor. Preferably the mixing in step (aa) is performed by kneading or mulling. The thus obtained mixture is subsequently shaped by pelletising, extrusion, granulating or crushing, preferably by extrusion. Preferably the mixture obtained has a solids content in the range of from 30 to 90% by weight, preferably of from 50 to 80% by weight. Preferably the mixture formed in step (aa) is a slurry and the slurry thus-obtained is shaped and dried by spray-drying. Preferably the slurry obtained has a solids content in the range of from 1 to 30% by weight, more preferably of from 5 to 20% by weight. Preferably the calcination is carried out at a temperature between 400 and 750° C., more preferably between 500 and 650° C. Further details are described in WO-A-9934917.

The Fischer-Tropsch process is typically carried out at a temperature in the range from 125 to 350° C., preferably 175 to 275° C. The pressure is typically in the range from 5 to 150 bar abs., preferably from 5 to 80 bar abs., in particular from 5 to 70 bar abs. Hydrogen ($H_2$) and carbon monoxide (synthesis gas) is typically fed to the process at a molar ratio in the range from 0.5 to 2.5. The gas hourly space velocity (GHSV) of the synthesis gas in the process of the present invention may vary within wide ranges and is typically in the range from 400 to 10000 Nl/l/h, for example from 400 to 4000 Nl/l/h. The term GHSV is well known in the art, and relates to the volume of synthesis gas in Nl, i.e. litres at STP conditions (0° C. and 1 bar abs), which is contacted in one hour with one litre of catalyst particles, i.e. excluding interparticular void spaces. In the case of a fixed catalyst bed, the GHSV may also be expressed as per litre of catalyst bed, i.e. including interparticular void space. The Fischer-Tropsch synthesis can be performed in a slurry reactor or preferably in a fixed bed. Further details are described in WO-A-9934917.

Synthesis gas may be obtained by well known processes like partial oxidation and steam reforming and combinations of these processes starting with a (hydro) carbon feedstock. Examples of possible feedstocks are natural gas, associated gas, refinery off-gas, residual fractions of crude oil, coal, pet coke and biomass, for example wood. Partial oxidation may be catalysed or non-catalyzed. Steam reforming may be for example conventional steam reforming, autothermal (ATR) reforming and convective steam reforming. Examples of suitable partial oxidation processes are the Shell Gasification Process and the Shell Coal Gasification Process.

The Fischer-Tropsch product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulphur and 1 ppm for nitrogen.

The catalyst system used in step (a) will at least comprise of a catalyst comprising of a matrix and a large pore molecular sieve. Examples of suitable large pore molecular sieves are of the faujasite (FAU) type as for example Zeolite Y, Ultra Stable Zeolite Y and Zeolite X. The matrix is preferably an acidic matrix. The acidic matrix will suitably comprise amorphous alumina and preferably more than 10 wt % of the catalyst is amorphous alumina. The matrix may further comprise, for example, aluminium phosphate, clay and silica and mixtures thereof. Amorphous alumina may also be used as a binder to provide the matrix with enough binding function to properly bind the molecular sieve. Examples of suitable catalysts are commercially available catalysts used in fluid catalytic cracking processes which catalysts comprise a Zeolite Y as the molecular sieve and at least alumina in the matrix.

The temperature at which feed and catalyst contact is between 450 and 650° C. More preferably the temperature is above 475° C. and even more preferably above 500° C. Good gasoline yields are seen at temperatures above 600° C. However higher temperatures than 600° C. will give rise to thermal cracking reactions and the formation of non-desirable gaseous products like for example methane and ethane. For this reason, the temperature is more preferably below 600° C. The process may be performed in various types of reactors. Because the coke make is relatively small, as compared to an FCC process operating on a petroleum-derived feed, it is possible to conduct the process in a fixed bed reactor. In order to be able to regenerate the catalyst more simply, preference is nevertheless given to either a fluidised bed reactor or a riser reactor. If the process is performed in a riser reactor, the preferred contact time is between 1 and 10 seconds and more preferred between 2 and 7 seconds. The catalyst to oil ratio is preferably between 2 and 20 kg/kg. It has been found that good results may be obtained at low catalyst to oil ratios of below 15 and even below 10 kg/kg.

This is advantageous because this means a higher productivity per catalyst resulting in, e.g. smaller equipment, less catalyst inventory, less energy requirement and/or higher productivity.

The catalyst system may advantageously also comprise of a medium pore size molecular sieve such to also obtain a high yield of propylene next to the gasoline fraction. Preferred medium pore size molecular sieves are zeolite beta, Erionite, Ferrierite, ZSM-5, ZSM-11, ZSM-12, ZSM-22, ZSM-23 or ZSM-57. The weight fraction of medium pore crystals on the total of molecular sieves present in this process is preferably between 2 and 20 wt %. The medium pore molecular sieve and the large pore molecular sieve may be combined in one catalyst particle or be present in different catalyst particles. Preferably, the large and medium pore molecular sieves are present in different catalyst particles for practical reasons. For example, the operator can thus add the two catalyst components of the catalyst system at different addition rates to the process. This could be required because of different deactivation rates of the two catalysts. The catalyst comprising the medium pore molecular sieve may also comprise of the above described matrix for the large pore molecular sieve catalyst particle. A suitable matrix is alumina. The molecular sieve may be dealuminated by for example steaming or other known techniques.

It has been found that the combination of the large pore molecular sieve, more preferably of the FAU type, in combination with the medium pore size molecular sieve, is important to achieve the high selectivities to the desired lower olefins, such as especially propylene and iso-butylene at the preferred catalyst to oil ratios as described above in a riser reactor. Applicants have found that, by performing the process according the invention with a large pore molecular sieve, more preferably of the FAU type, in combination with the medium pore size molecular sieve, as described above, not only lower olefin yield improves, but also the yield to iso-butane and iso-butylene increases. Sometimes twice the amount of iso-butane is obtained when compared to a similar process performed in the absence of added medium pore size catalyst.

In step (b) a gasoline fraction is isolated from the product of step (a) and a fraction rich in iso-butylene and iso-butane. Isolation of said fractions is suitably performed by means of distillation. In this invention a gasoline or gasoline fraction is a fraction boiling for more than 90 wt % between 25 and 215° C., preferably boiling for more than 95 wt % in said boiling range. Part of the iso-butylene may suitably be saturated in order to obtain a stoichimetric reaction ratio between the iso-butylene and the iso-butane for use in the alkylation step (c).

In step (c) iso-butylene and iso-butane are subjected to an alkylation reaction to prepare 2,2,4-trimethylpentane. In addition to iso-butylene also other olefins, such as the $C_3$-$C_8$ olefins, as obtained in step (a), may be part of the alkylation feed. The alkylation step may be performed using well known processes as for example the AlkyClean process as described in "The Process: A new solid acid catalyst gasoline alkylation technology," NPRA 2002 Annual Meeting, Mar. 17-19, 2002, the sulphuric acid alkylation process as for example described in Lerner, H., "Exxon sulfuric acid alkylation technology," Handbook of Petroleum Refining Processes, 2nd ed., R. A. Meyers, Ed., pp. 1.3-1.14, The Topsøe fixed-bed alkylation (FBA) technology and the The UOP Indirect Alkylation (In-Alk) and Alkylene processes. Other references to alkylation processes are found in U.S. Pat. No. 4,125,566.

In step (c) trimethyl substituted aliphatic compounds and especially 2,2,4-trimethylpentane, are prepared. Such compounds have a high octane number and by blending these compounds with the gasoline fraction obtained in step (b) an aliphatic gasoline is obtained which has an improved octane number than was previously achievable by means of the state of the art processes.

The invention is also directed to the following aliphatic gasoline as obtainable from the above process. An aliphatic gasoline component comprising more than 90 wt % of a mixture of trimethyl substituted compounds and monomethyl substituted compounds in a weight ratio of trimethyl to monomethyl compounds of at least 0.03 and wherein the compounds may be paraffins and olefins. The weight ratio of trimethyl to monomethyl compounds is preferably greater than 0.05. Preferably the content of such trimethyl-substituted compounds boiling in the gasoline range is as high as possible because of their intrinsic high octane values. In the present process typically this ratio will not be higher than 0.4, suitably not higher than 0.3. Preferably the content of 2,2,4-trimethylpentane is between 2 and 20 wt %. The content of trimethyl substituted and monomethyl substituted compounds can be measured by gas chromatography as described in ASTM D-6730.

Optionally the aliphatic gasoline is hydrogenated in order to reduce the olefins content in order to meet gasoline fuel specifications valid for certain markets.

The invention is also directed to the use of the above gasoline fraction as part of a gasoline fuel composition suitable for use in an ignition spark engine. More preferably such a fuel composition comprises the aliphatic gasoline component as described above, one or more fuel additives, an aromatics content of between 1 and 22 vol % (as measured by ASTM D5580-95), a motor octane number of greater than 90 and a sulphur content of below 15 ppm by weight (as measured by ASTM D5453-93). The composition may also contain gasoline fuels as obtained from a mineral crude source and/or from a pyrolysis process which main products are lower olefins. The additives are typically gasoline fuel additives well known to the skilled person.

The invention will be illustrated with the following non-limiting examples.

EXAMPLES A-D

A Fischer-Tropsch product having the properties as listed in Table 1 was contacted with a hot regenerated catalyst at different temperatures and contact times at a catalyst to oil ratio of 4 kg/kg. The catalyst was a commercial FCC catalyst comprising an alumina matrix and Ultra Stable Zeolite Y, which had been obtained from a commercially operating FCC unit. The Zeolite Y content was 10 wt %. The operating conditions are presented in Table 3.

TABLE 1

| | |
|---|---|
| Initial boiling point | 100° C. |
| Fraction boiling between 25 and 215° C. (wt %) | 46.8 |
| Fraction boiling between 215 and 325° C. (wt %) | 42.2 |
| Fraction boiling above 325° C. (wt %) | 11.0 |

EXAMPLES 1-4

A Fischer-Tropsch product having the properties as listed in Table 2 was contacted with a hot regenerated catalyst at different temperatures and contact times as in Examples A-D. The Fischer-Tropsch product was obtained according to Example VII using the catalyst of Example III of WO-A-9934917. The operating conditions are presented in Table 3.

TABLE 2

| | |
|---|---|
| Initial boiling point | 280° C. |
| Weight Fraction having 10 or less carbon atoms (%) | 0 |
| Weight Fraction having more than 30 carbon atoms (%) | 80 |
| Weight Fraction having more than 60 carbon atoms (%) | 50 |
| Ratio of $C_{60}$+/$C_{30}$+ | 0.63 |

TABLE 3

| Experiment | Example | Temperature (° C.) | Contact Time (seconds) |
|---|---|---|---|
| A | 1 | 500 | 4.06 |
| B | 2, 5 | 525 | 0.7 |
| C | 3, 6 | 525 | 4.06 |
| D | 4, 7 | 625 | 0.7 |

TABLE 4

| | Gasoline yield (wt %) (*) | Middle distillate yield (wt %) (**) | Gasoline iso-paraffins (wt % in gasoline fraction) | Gasoline iso-olefins (wt % in gasoline fraction) | Gasoline normal olefins (wt % in gasoline fraction) |
|---|---|---|---|---|---|
| A | — | — | — | — | — |
| 1 | 74.00 | 11.06 | 31.04 | 36.96 | 18.09 |
| B | 52.58 | 35.88 | 2.93 | 8.00 | 14.27 |
| 2 | 52.90 | 13.27 | 17.10 | 50.15 | 25.83 |
| C | 68.70 | 13.63 | 15.59 | 16.93 | 8.14 |
| 3 | 70.29 | 5.91 | 8.64 | 62.90 | 26.06 |
| D | 53.86 | 26.24 | 4.67 | 21.47 | 18.54 |
| 4 | 46.12 | 7.43 | 14.48 | 40.21 | 31.99 |

(*) Gasoline fraction defined as the distillation cut boiling between 25 and 215° C.
(**) Middle distillate defined as the distillation cut boiling between 215 and 325° C.

From Table 4, it can be derived that the process according to the invention will provide a high yield to gasoline. The gasoline fraction contains considerably more compounds, which contribute to a high octane number. The prior art method yields a predominantly normal paraffin product, which will have a considerably lower octane number.

Table 4 also shows that a high gasoline yield is obtained at high contact times and relatively mild temperatures (Examples 1 and 3).

EXAMPLES 5-7

Examples 2-4 were repeated with the Fischer-Tropsch product having the properties as listed in Table 5 and the conditions of Table 3. The results are presented in Table 6.

TABLE 5

| | |
|---|---|
| Initial boiling point | 100° C. |
| Weight Fraction having 10 or less carbon atoms (%) | 14 |
| Weight Fraction having more than 30 carbon atoms(%) | 62 |
| Weight Fraction having more than 60 carbon atoms(%) | 39 |
| Ratio of $C_{60}$+/$C_{30}$+ | 0.63 |

TABLE 6

| Example | Gasoline yield (wt %) on total product | Gasoline iso-paraffins (wt % in gasoline fraction) | Gasoline iso-olefins (wt % in gasoline fraction) | Gasoline normal olefins (wt % in gasoline fraction) |
|---|---|---|---|---|
| 5 | 52.85 | 14.91 | 43.64 | 24.04 |
| 6 | 70.05 | 9.71 | 55.84 | 23.30 |
| 7 | 47.25 | 12.94 | 37.25 | 29.87 |

EXAMPLE 8

Example 6 was repeated except that part of the catalyst was exchanged for a 25 wt % ZSM-5 containing catalyst. The content of ZSM-5 based catalyst on the whole catalyst charge was 20 wt % (as calculated on the total catalyst weight). The gasoline yield was 47.99 wt %. The content of iso-paraffins was 4.20 wt %, iso-olefins was 53.53 wt % and normal olefins was 22.72 wt % in the gasoline fraction. The propylene yield was 15.34 wt % as compared to a propylene yield in Example 6 of 4.85 wt % (calculated on total product).

EXAMPLE 9

Example 2 was repeated except that part of the catalyst was exchanged for a 25 wt % ZSM-5 containing catalyst. The content of ZSM-5 based catalyst on the whole catalyst charge was 20 wt % (as calculated on the total catalyst weight). The results are presented in Table 7.

EXAMPLE 10

Example 3 was repeated except that part of the catalyst was exchanged for a 25 wt % ZSM-5 containing catalyst. The content of ZSM-5 based catalyst on the whole catalyst charge was 20 wt % (as calculated on the total catalyst weight). The results are presented in Table 7.

TABLE 7

| Example | Gasoline yield on product (wt %) (*) | Gasoline iso-paraffins (wt % in gasoline fraction) | Gasoline iso-olefins (wt % in gasoline fraction) | Gasoline normal olefins (wt % in gasoline fraction) |
|---|---|---|---|---|
| 2 | 52.90 | 17.10 | 50.15 | 25.83 |
| 3 | 70.29 | 8.64 | 62.90 | 26.06 |

TABLE 7-continued

| | | | | |
|---|---|---|---|---|
| 9 | 55.88 | 37.75 | 21.79 | 19.37 |
| 10 | 45.76 | 0.83 | 65.62 | 27.53 |

| | Iso-butylene yield (wt %) (*) | Iso-butane yield (wt %) (*) | n-butenes (wt %) (*) | Propylene yield (wt %) (*) |
|---|---|---|---|---|
| 2 | 2.08 | 1.41 | 2.82 | 2.77 |
| 3 | 2.72 | 0.86 | 3.33 | 4.73 |
| 9 | 4.77 | 2.17 | 6.10 | 13.89 |
| 10 | 7.84 | 3.42 | 9.78 | 16.45 |

(*) all yields in Table 7 on total product

Table 7 illustrates the high content of iso-butylene and iso-butane formed in this process step making available a feedstock for the alkylation step to prepare especially 2,2,4-trimethylpentane according to well known alkylation processes.

The invention claimed is:

1. A process to prepare an aliphatic gasoline component comprising (a) contacting a Fischer-Tropsch synthesis product with a catalyst system comprising a catalyst, which catalyst comprises an acidic matrix and a large pore molecular sieve in a riser reactor at a temperature of between 450 and 650° C. at a contact time of between 1 and 10 seconds and at a catalyst to oil ratio of between 2 and 20 kg/kg;

(b) isolating from the product of step (a) a gasoline fraction and a fraction comprising iso-butane and iso-butylene wherein the amount of iso-butylene is greater than or about equal to the amount of iso-butane;

(c) subjecting the iso-butane and the iso-butylene obtained in step (b) to an alkylation step to prepare a trimethyl substituted pentane; and (d) combining the gasoline fraction obtained in step (b) with the trimethyl substituted pentane as obtained in step (c).

2. The process according to claim 1, wherein the feed used in step (a) has a weight ratio of compounds having at least 60 or more carbon atoms and compounds having at least 30 carbon atoms of at least 0.2 and wherein at least 30 wt % of the compounds have at least 30 carbon atoms.

3. The process according to claim 2, wherein at least 50 wt % of the compounds in the feed to step (a) have at least 30 carbon atoms.

4. The process according to claim 3, wherein the weight ratio of compounds having at least 60 or more carbon atoms and compounds having at least 30 carbon atoms in the Fischer-Tropsch product is at least 0.4 in the feed to step (a).

5. The process according to claim 1, wherein the temperature in step (a) is below 600° C.

6. The process according to claim 1, wherein the acidic matrix is alumina.

7. The process according to claim 1, wherein the large pore molecular sieve is of the Faujasite type.

8. The process according to claim 1, wherein the catalyst system in step (a) also comprises zeolite beta, Erionite, Ferrierite, ZSM-5, ZSM-11, ZSM-12, ZSM-22, ZSM-23 or ZSM-57.

9. The process according to claim 1, wherein the Fischer-Tropsch synthesis product used as feed in step (a) is obtained by means of a cobalt-catalyzed Fischer-Tropsch synthesis process.

10. The process according to claim 9, wherein the cobalt catalyst is obtained by (aa) mixing (1) titania or a titania precursor, (2) a liquid, and (3) a cobalt compound, which is at least partially insoluble in the amount of liquid used, to form a mixture; (bb) shaping and drying of the mixture thus obtained; and (cc) calcination of the composition thus obtained.

* * * * *